US009725864B2

(12) United States Patent
Ardavanis et al.

(10) Patent No.: US 9,725,864 B2
(45) Date of Patent: Aug. 8, 2017

(54) VARIABLE-DRAFT BARGE, AND SYSTEM AND METHOD OF TRANSFERRING LOADS FROM THE BARGE TO A SUPPORTING STRUCTURE IN A BODY OF WATER

(71) Applicant: SAIPEM S.p.A., San Donato Milanese (IT)

(72) Inventors: Kimon Ardavanis, San Donato Milanese (IT); Andrea Oldani, San Donato Milanese (IT); Roberto Faldini, San Donato Milanese (IT)

(73) Assignee: SAIPEM S.p.A., San Donato Milanese (IT)

( * ) Notice: Subject to any disclaimer, the term of this patent is extended or adjusted under 35 U.S.C. 154(b) by 111 days.

(21) Appl. No.: 14/762,158

(22) PCT Filed: Jan. 24, 2014

(86) PCT No.: PCT/IB2014/058530
§ 371 (c)(1),
(2) Date: Jul. 20, 2015

(87) PCT Pub. No.: WO2014/115117
PCT Pub. Date: Jul. 31, 2014

(65) Prior Publication Data

US 2015/0322639 A1 Nov. 12, 2015

(30) Foreign Application Priority Data

Jan. 24, 2013 (IT) ..... MI2013A0111

(51) Int. Cl.
*E02B 17/02* (2006.01)
*E02B 17/00* (2006.01)
(Continued)

(52) U.S. Cl.
CPC ..... *E02B 17/00* (2013.01); *B63B 35/003* (2013.01); *B63B 35/28* (2013.01); *B63B 43/06* (2013.01);
(Continued)

(58) Field of Classification Search
CPC ..... E02B 2017/0047; E02B 17/021
(Continued)

(56) References Cited

U.S. PATENT DOCUMENTS 3,138,932 A 6/1964 Kofahl et al.
3,412,564 A 11/1968 McClintock
(Continued)

FOREIGN PATENT DOCUMENTS

GB 2 176 827 1/1987
WO 2010/098898 9/2010
WO 2011/028568 3/2011

OTHER PUBLICATIONS

International Search Report and Written Opinion for International Application No. PCT/IB2014/058530 dated May 21, 2014.
(Continued)

*Primary Examiner* — Sunil Singh
(74) *Attorney, Agent, or Firm* — Neal, Gerber & Eisenberg LLP

(57) ABSTRACT

A variable-draft barge configured to transfer loads in a body of water, and having a water line which is a function of the draft; the barge having: a hull; an underbody; at least one first chamber located in the hull and floodable selectively to alter the draft of the barge; at least one flood valve located below the water line to flood the first chamber; and a control device configured to selectively open the flood valve to flood the first chamber.

26 Claims, 7 Drawing Sheets

(51) Int. Cl.
*B63B 35/28* (2006.01)
*B63B 43/06* (2006.01)
*B63B 35/00* (2006.01)

(52) U.S. Cl.
CPC .. *E02B 17/0034* (2013.01); *E02B 2017/0043* (2013.01); *E02B 2017/0047* (2013.01); *E02B 2017/0056* (2013.01)

(58) Field of Classification Search
USPC ..... 114/259, 260, 263; 414/137.9, 138.1, 414/138.2, 138.5; 405/196, 200, 203–209
See application file for complete search history.

(56) References Cited

U.S. PATENT DOCUMENTS 3,790,009 A * 2/1974 Hauber ..... B63B 35/003 405/196
5,403,124 A 4/1995 Kocaman et al.
5,522,680 A 6/1996 Hoss et al.
6,027,287 A 2/2000 Faldini
6,293,734 B1 9/2001 Thomas et al.
6,347,909 B1 2/2002 Kocaman
6,981,823 B2 1/2006 Roraas et al.
9,033,617 B2 * 5/2015 Perol ..... B63B 9/065 405/203
2007/0253797 A1 11/2007 Thomas

OTHER PUBLICATIONS

Notification Concerning Submission, Obtention or Transmittal of Priority document for International Application No. PCT/IB2014/058530 dated May 6, 2014.
Communication regarding updated address of the first designated inventor to International Bureau of WIPO for International Application No. PCT/IB2014/058530 dated Jul. 6, 2015.

* cited by examiner

VARIABLE-DRAFT BARGE, AND SYSTEM AND METHOD OF TRANSFERRING LOADS FROM THE BARGE TO A SUPPORTING STRUCTURE IN A BODY OF WATER

PRIORITY CLAIM

This application is a national stage application of PCT/IB2014/058530, filed on Jan. 24, 2014, which claims the benefit of and priority to Italian Patent Application No. MI2013A 000111, filed on Jan. 24, 2013, the entire contents of which are each incorporated by reference herein.

BACKGROUND

Certain known platform modules are normally transported and installed in a body of water using vessels equipped with lifting systems. These systems call for the use of relatively high-cost equipment, involve considerable risk by having to lift relatively extremely heavy platform modules, and are seriously limited by environmental (sea bed, sea, and weather) conditions.

A so-called 'float-over' technique has recently been developed whereby a barge is used to support at least one platform module. The barge is moved into position between the legs of the supporting structure in a body of water. The platform module is then moved vertically by the combined operation of mechanical devices (heavy-duty hydraulic jacks), and by adjusting the ballast (draft) of the barge.

The barge is fixed to the supporting structure by a known mooring system configured to limit horizontal movement of the barge.

This type of mooring system, however, fails to limit vertical movement of the barge, which for the most part is uncontrollable and dependent on water and weather conditions.

Vertical movement of the barge makes the barge relatively difficult to connect the platform module to the supporting structure, and to detach the barge completely from the platform. At the connecting stage, vertical movement of the barge may result in the platform module colliding with the supporting structure, thus impairing connection and possibly also damaging both.

As the barge is being detached, on the other hand, vertical movement of the barge may cause barge to impact the installed platform module.

Research into the forces involved at the connecting and detaching stages shows the difficulties posed, mostly in areas with typically unpredictable water conditions, can be overcome by carrying out the connecting and detaching stages as fast as possible.

One known system configured to transfer a platform module from a barge to a supporting structure in a body of water is described in document U.S. Pat. No. 6,027,287 filed by the present Applicant. This system is relatively fast at the connecting and detaching stages, but is unacceptably slow in emergency reversing situations.

Other similar methods are described in EP Patent No. 0097069, U.S. Pat. Nos. 5,403,124, 5,522,680, 6,293,734, 6,347,909 and U.S. Pat. No. 6,981,823, and more recently in PCT Patent Application WO 2010098898 and PCT Patent Application WO 2011028568.

SUMMARY

The present disclosure relates to a variable-draft barge, and to a system and method of transferring loads from the barge to a supporting structure in a body of water. More specifically, the present disclosure relates to a system and method of transferring a platform superstructure (typically a module, integrated deck, etc.) from a barge to a supporting structure in a body of water.

It is therefore an advantage of the present disclosure to provide a variable-draft barge for use in a system configured to transfer loads from the barge to a supporting structure in a body of water, and configured to eliminate certain of the drawbacks of certain of the known art.

According to the present disclosure, there is provided a variable-draft barge configured to transfer loads in a body of water, and having a water line which is a function of the draft; the barge comprising:

- a hull;
- an underbody;
- at least one first chamber located in the hull and selectively floodable to alter the draft of the barge;
- at least one flood valve located below the water line to flood the first chamber; and
- a control device configured to selectively open the flood valve to flood the first chamber.

Using a flood valve below the water line of the barge, the barge chamber is flooded relatively rapidly, thus relatively rapidly altering the draft as required, and so minimizing the time taken to connect the load to the supporting structure, which is a highly critical stage that must be performed as fast as possible.

By virtue of the present disclosure, the time taken to connect the load to the supporting structure is in the region of a few minutes, which is fast enough to perform the operation to a certain degree of precision, while at the same time preventing collision between the parts and an increase in the potentially damaging forces exchanged between the load and the supporting structure.

The barge according to the present disclosure is also relatively cheaper and relatively simpler in design than known solutions based exclusively on the use of pump systems configured to alter the draft, which makes connecting the load to the supporting structure much slower and therefore much more hazardous.

In certain embodiments of the present disclosure, the flood valve is located along the underbody. This way, as soon as the flood valve opens, water flows immediately into the barge to fill the first chamber faster.

In certain embodiments of the present disclosure, the flood valve is a throttle valve. Throttle valves are relatively reliable, relatively easy to control and maintain, and enable a relatively large flow passage.

In certain embodiments of the present disclosure, the flood valve is a gate valve. Gate valves are relatively reliable, and enable a relatively large flow passage.

In certain embodiments of the present disclosure, the flood valve is over 0.5 meters (19.685 inches) in diameter, such as 0.8 meters to 1.2 meters (31.4961 inches to 47.2441 inches) in diameter. The large diameter of the flood valve enables large amounts of water to be fed into the barge, to fill the barge chambers, and so increase draft, faster.

In certain embodiments of the present disclosure, the barge comprises at least one second chamber floodable selectively and located at a higher level than the first chamber; and at least one pump to transfer water from the first chamber to the second chamber. In other words, in these embodiments, opening the flood valve only provides for fast filling the first chamber, whereas the second chamber is filled by a pump transfer system. Transferring water from the first chamber to the second chamber enables the first chamber to be flooded again, to further increase the draft of the barge, by simply opening the flood valve.

In various embodiments of the present disclosure, the second chamber is adjacent to, and, in certain embodiments, over, the first chamber. This simplifies transferring water from the first chamber to the second by minimizing the distance between them.

In certain embodiments of the present disclosure, the barge comprises a plurality of first chambers connected to one another by connecting openings. This way, opening the flood valve floods the first chambers relatively evenly, to avoid rocking the barge, and so keeping the barge stable when altering the draft.

In certain embodiments of the present disclosure, the barge comprises a plurality of first chambers; and at least a first tunnel connecting the body of water to at least one first chamber of the plurality of first chambers; the flood valve communicating fluidically with the first tunnel. This way, opening the flood valve immediately floods the tunnel, and then the first chambers connected to the tunnel.

The presence of the tunnel prevents any malfunctioning of the flood valve from accidentally flooding the first chambers unevenly and so bringing about a potentially hazardous alteration in the draft of the barge. In which case, uncommanded opening of the flood valve only fills the tunnel, with no serious alteration in the draft of the barge.

Above all, the tunnel provides for more evenly flooding the first chambers connected to the tunnel, to avoid rocking the barge, and so keeping the barge relatively stable when altering the draft.

In certain embodiments, the first chamber is connected to the first tunnel utilizing at least one feed valve; the control device being configured to selectively open and close the feed valve. This way, flooding of the first chamber connected to the tunnel is controlled by the control device, to further ensure against accidental flooding of the first chamber.

In certain embodiments, the barge comprises a second tunnel which communicates with a further first chamber of the plurality of first chambers.

The second tunnel solution enables more first chambers to be catered to than the one-tunnel solution.

In certain embodiments of the present disclosure, the second chamber has at least one fast-drain device connecting the second chamber to the outside of the barge. This way, when the second chamber is flooded, the draft of the barge can be reduced relatively rapidly by simply activating the fast-drain device.

In certain embodiments of the present disclosure, the fast-drain device comprises a fast-drain valve configured to drain the second chamber when the fast-drain valve is above the water line. This way, simply opening the drain valve drains the water from the second chamber with no need for extraction, the outflow of water being generated by the difference in pressure between the inside of the second chamber and the outside (above the water line).

Another advantage of the present disclosure is to provide a system configured to transfer a load from a barge to a supporting structure in a body of water, which is faster than known systems in transferring the load, while at the same time being relatively cheap and relatively easy to produce.

According to the present disclosure, there is provided a system configured to transfer loads from a barge to a supporting structure in a body of water. In certain embodiments, this system includes a load, a variable-draft barge including: a hull, an underbody, a first chamber located in the hull and being selectively floodable to alter a draft of the barge, a flood valve located below a water line to flood the first chamber, said water line being a function of the draft of the barge, and a control device configured to selectively open the flood valve to flood the first chamber; and a supporting structure resting on a bed of a body of water and having at least one supporting member connectable to the load. This way, the inner chambers on the barge can be flooded relatively rapidly to connect the load relatively quickly to the supporting structure.

Another advantage of the present disclosure is to provide a method of transferring loads from a barge to a supporting structure in a body of water, which is simple and faster than known methods in transferring the load.

According to the present disclosure, there is provided a method of transferring loads from a barge to a supporting structure in a body of water; the barge having a water line which is a function of the draft, and comprising a hull, an underbody, at least one first chamber located in the hull and floodable selectively to alter the draft of the barge, at least one flood valve located below the water line to flood the first chamber, and a control device configured to selectively open the flood valve to flood the first chamber; the supporting structure resting on the bed of a body of water, and having at least one supporting member connectable to the load; the method comprising the steps of:

moving the barge, supporting a load with at least one coupling member, into a transfer position, in which the coupling member on the load is substantially aligned with the supporting member of the supporting structure;

increasing the draft of the barge by flooding at least the first chamber, so as to bring the coupling member of the load into contact with the supporting member of the supporting structure, and completely transfer the load from the barge to the supporting structure; and moving the barge from the transfer position;

wherein the step of increasing the draft of the barge comprises opening the flood valve to flood at least the first chamber.

This way, the method according to the present disclosure ensures the draft of the barge is increased, and consequently the load is connected and transferred from the barge to the supporting structure, relatively quickly and relatively reliably.

It should be appreciated that simply opening the flood valve relatively rapidly increases the draft of the barge. This therefore minimizes the time taken to connect the load to the supporting structure, which is a highly critical stage that must be performed as fast as possible.

Using the method according to the present disclosure, the time taken to connect the load to the supporting structure is in the region of a few minutes.

In certain variations of the method according to the present disclosure, the barge comprises at least one second chamber floodable selectively and at a higher level than the first chamber; and at least one pump configured to transfer water from the first chamber to the second chamber; the step of increasing the draft of the barge comprising the steps of:

flooding at least the first chamber; and feeding the water in the first chamber to at least the second chamber utilizing at least one pump.

In other words, in these embodiments, opening the flood valve only provides for fast filling the first chamber, whereas the second chamber is filled by a pump transfer system. Transferring water from the first chamber to the second enables the first chamber to be flooded again.

In certain variations of the method according to the present disclosure, the step of increasing the draft of the barge also comprises the step of flooding at least the first chamber again, after the water in the first chamber is transferred to the second chamber. This way, simply opening the flood valve further increases the draft of the barge by enabling the first chamber to be flooded again.

In one variation, the method according to the present disclosure also comprises the step of reducing the draft of the barge by draining the second chamber using a fast-drain device. This enables connection of the load to the supporting structure to be reversed. That is, draining the second chamber brings about a reduction in draft, that is potentially vital to recover the load in an emergency.

In a variation of the method according to the present disclosure, the step of draining the second chamber comprises the step of opening at least one fast-drain valve of the second chamber when the fast-drain valve is above the water line. This way, simply opening the drain valve drains the water from the second chamber with no need for extraction, the outflow of water being generated by the difference in pressure between the inside of the second chamber and the outside (above the water line).

Additional features and advantages are described in, and will be apparent from the following Detailed Description and the figures.

BRIEF DESCRIPTION OF THE DRAWINGS

A non-limiting embodiment of the present disclosure will be described by way of example with reference to the attached drawings, in which.

DETAILED DESCRIPTION

Figure 1:
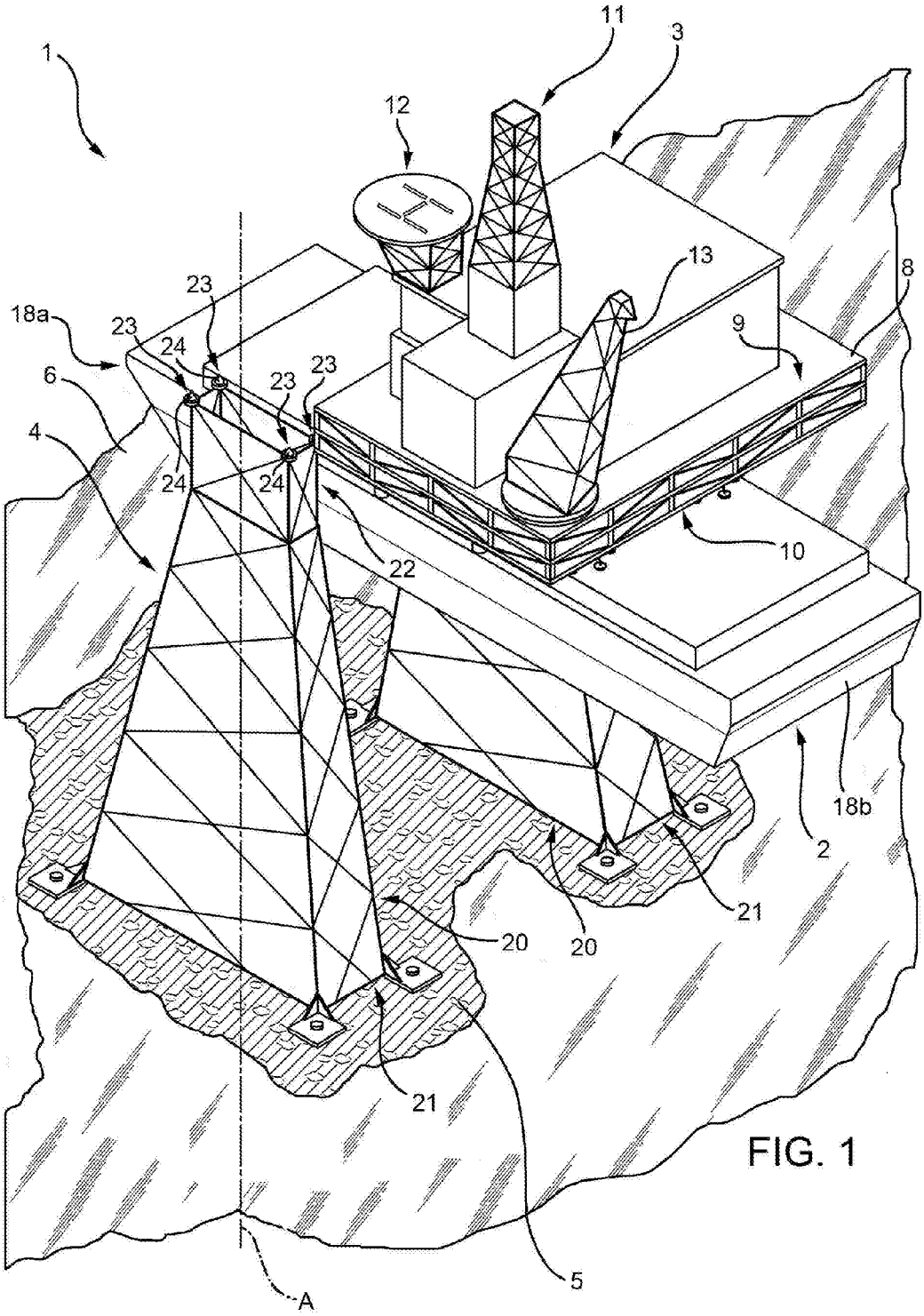
FIG. 1 shows a view in perspective, and in a first operating position, of the system configured to transfer a load from a barge to a supporting structure in a body of water according to the present disclosure.

Referring now to the example embodiments of the present disclosure illustrated in FIGS. 1 to 16, number 1 in FIG. 1 indicates a system configured to transfer a load from a barge to a supporting structure in a body of water in accordance with the present disclosure.

System 1 comprises a barge 2 supporting a load 3; and a supporting structure 4 resting on the bed 5 of a body of water 6.

More specifically, load 3 is supported on barge 2 so as to project at least partly from barge 2.

In the non-limiting example described and illustrated herein, load 3 is a top module of an underwater well drilling and/or hydrocarbon extraction platform. The module may be used in general for any offshore function, not necessarily relating to hydrocarbons, such as wind-related functions.

Module 3 has at least one deck 8 with a top face 9 and a bottom face 10.

A drilling rig 11 is located on one side of top face 9 of deck 8. Close to drilling rig 11, there is a further deck 12 which serves as a heliport. Module 3 also comprises at least one crane 13 located on deck 8, on the opposite side of drilling rig 11 to deck 12.

Module 3 also comprises miscellaneous tooling and devices, engine rooms, and living quarters (not shown in the drawings).

Figure 2:
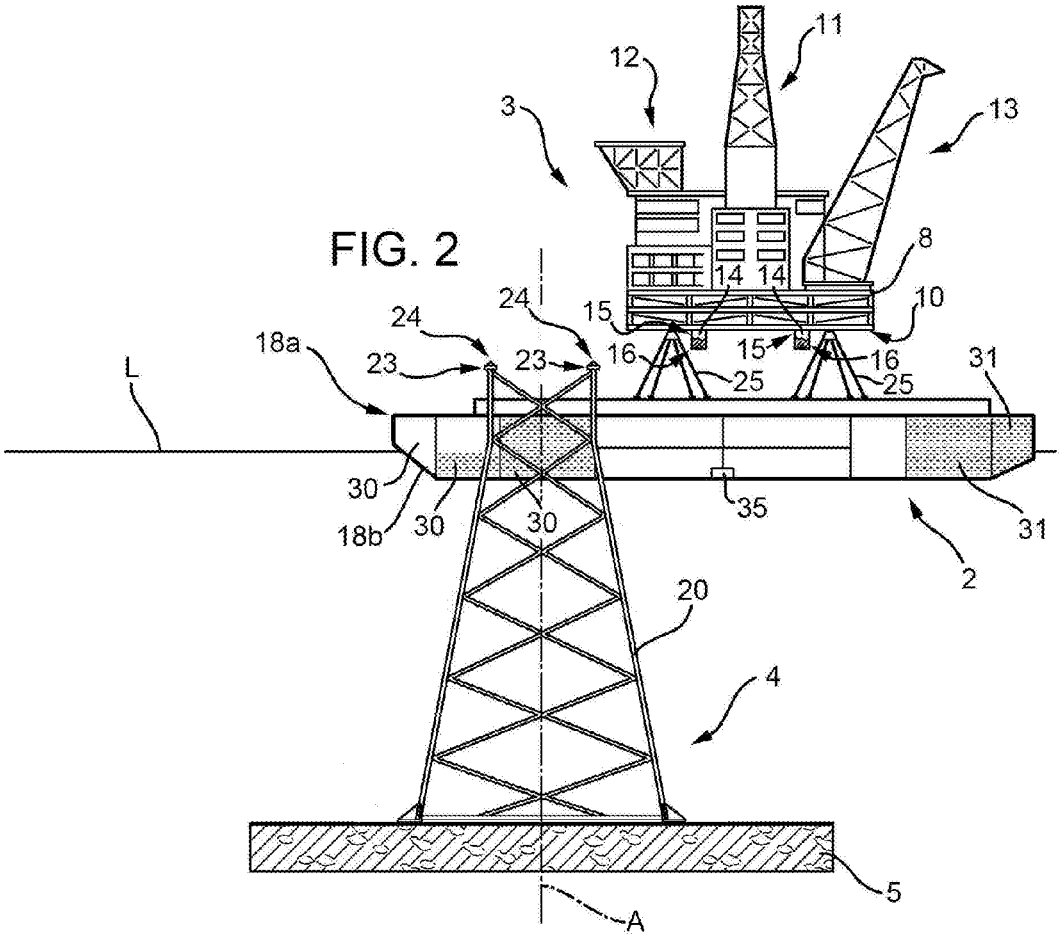
FIG. 2 shows a partly sectioned side view, with parts removed for clarity, of the FIG. 1 system.

As shown in FIG. 2, module 3 has at least four coupling members 14 (only two shown in FIG. 2) projecting from bottom face 10 of deck 8.

In the non-limiting example described and illustrated herein, coupling members 14 are defined by pylons.

In certain embodiments, pylons 14 are eight in number or quantity, and located at the corners of two substantially aligned quadrilaterals.

In certain embodiments, pylons 14 are substantially perpendicular to bottom face 10.

In certain embodiments, each pylon 14 is substantially cylindrical, and has one end 15 connected to bottom face 10; and one end 16, which has a recess 17 (shown more clearly in FIG. 12) defining a coupling seat.

In certain embodiments, recess 17 is conical or truncated-cone-shaped.

With reference to FIGS. 1 and 2, supporting structure 4 comprises two legs 20 resting on and fixed to bed 5 of body of water 6.

In the attached drawings, legs 20 are defined by lattice structures, but may be defined by tubular or other types of structures. Each leg 20 extends along an axis A, and has a base portion 21 fixed to bed 5 of body of water 6; and an end portion 22 configured to fix to module 3.

More specifically, end portion 22 of each leg 20 has at least two supporting members 23.

In the non-limiting example described and illustrated herein, each end portion comprises four supporting members 23 located at the corners of a quadrilateral.

Figure 12:
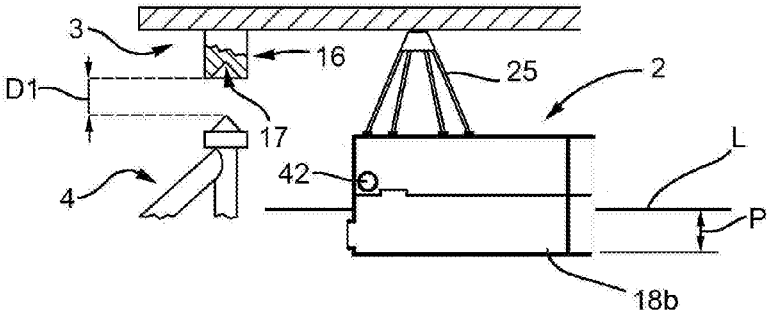
FIGS. 12, 13, 14, 15, and 16 show larger-scale, partly sectioned front views, with parts removed for clarity, of a detail of the system according to the present disclosure in the FIGS. 2 and 4-7 operating positions respectively.

In certain embodiments, each supporting member 23 has a pointed end 24 configured to engage recess 17 of respective pylon 14 of module 3 (FIG. 12).

Barge 2 extends substantially along a plane perpendicular to axis A, and comprises a hull 18*a* configured to float in a body of water 6, with a water line L.

Water line L defines underbody 18*b* constituting the immersed part of hull 18*a*.

Barge 2 comprises a plurality of supports 25 (FIG. 2) configured to support load 3 during transport and when transferring load 3 from barge 2 to supporting structure 4. In certain embodiments, supports 25 are lattice-structured. In variations not shown in the drawings, supports 25 may be defined by tubular or other types of structures.

In certain embodiments, barge 2 is not self-propelled, and is towed when required.

Figure 8:
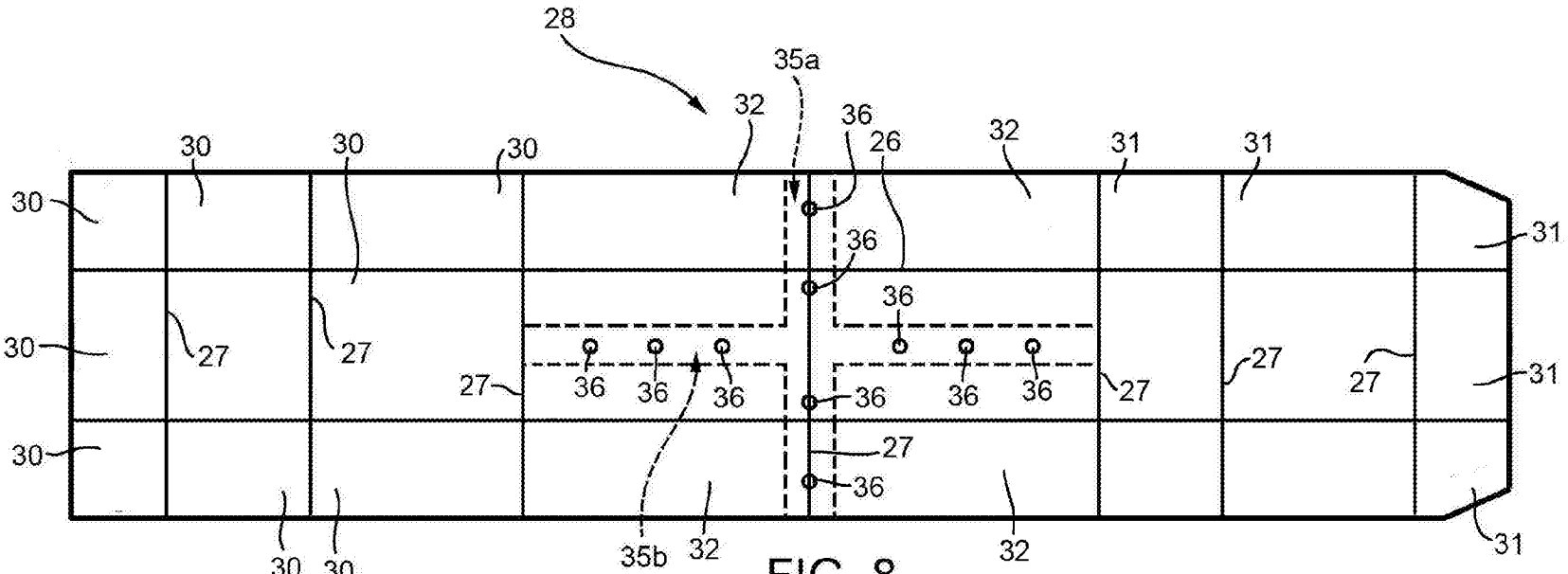
FIG. 8 shows a partly sectioned top plan view, with parts removed for clarity, of a first detail of the FIG. 1 system.

With reference to FIG. 8, hull 18*a* (FIG. 2) has two longitudinal partitions 26 extending from stern to bow; and a plurality of transverse partitions 27 substantially perpendicular to longitudinal partitions 26.

Longitudinal partitions 26 and transverse partitions 27 define a plurality of airtight chambers 28. The chambers of the plurality of chambers 28 can be selectively flooded or drained independently of one another, to achieve a given or designated draft when transferring load 3 from barge 2 to supporting structure 4.

Figure 9:
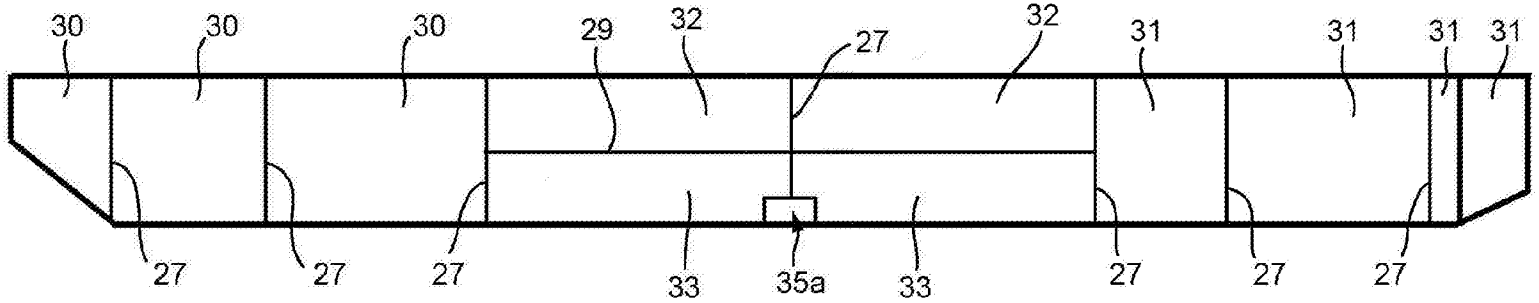
FIG. 9 shows a partly sectioned side view, with parts removed for clarity, of the first detail in FIG. 8.

With reference to FIG. 9, barge 2 has an intermediate deck 29, which divides the chambers of the plurality of chambers 28 arranged at the centre of barge 2 into upper and lower portions.

In the non-limiting example described and illustrated herein, the plurality of chambers 28 comprises nine fore chambers 30, nine aft chambers 31, six upper intermediate chambers 32, and six lower intermediate chambers 33.

Barge 2 also has two tunnels 35*a*, 35*b* extending along the centre bottom of barge 2 and communicating with lower intermediate chambers 33. Tunnels 35*a*, 35*b* in certain embodiments, extend crosswise to each other in the form of a cross. In the non-limiting example described and illustrated herein, tunnels 35*a*, 35*b* are perpendicular to each other.

Barge 2 also comprises a plurality of flood valves 36 located along underbody 18*b* (FIG. 2), beneath water line L, and interposed between body of water 6 and one or more lower intermediate chambers 33.

Flood valves 36 are controlled by a control device (not shown in the drawings for the sake of simplicity) configured to selectively open flood valves 36 to flood respective lower intermediate chambers 33.

In the non-limiting example described and illustrated herein, flood valves 36 communicate fluidically with tunnels 35*a*, 35*b*, and are configured to flood tunnels 35*a*, 35*b* when opened.

Figure 10:
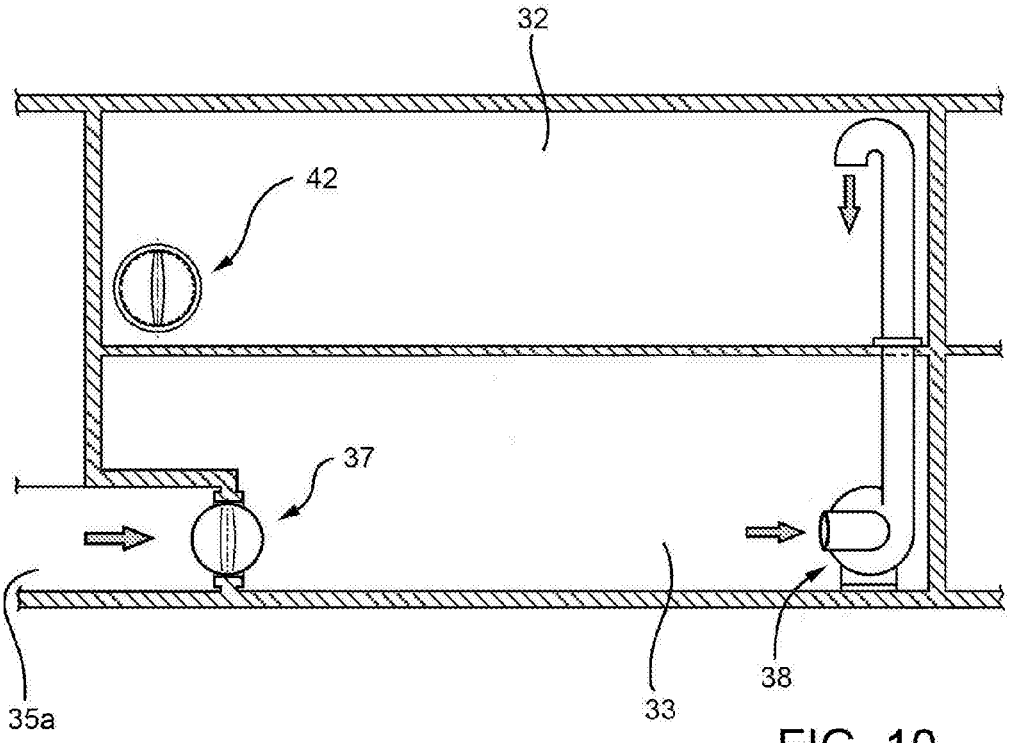
FIG. 10 shows a partly sectioned side view, with parts removed for clarity, of a second detail of the system configured to transfer a load from a barge to a supporting structure in a body of water according to the present disclosure.

Tunnels 35*a*, 35*b* communicate with lower intermediate chambers 33 via respective feed valves 37 (only one shown in FIG. 10).

Feed valves 37 are controlled by the control device, which is configured to selectively open feed valves 37 to flood respective lower intermediate chambers 33 with water from tunnels 35*a*, 35*b*. In other words, tunnels 35*a*, 35*b* are dedicated to flooding lower intermediate chambers 33.

In actual use, opening flood valves 36 floods tunnels 35*a*, 35*b*, and subsequently opening feed valves 37 floods lower intermediate chambers 33.

In certain embodiments, flood valves 36 are large-section throttle valves.

In the non-limiting example described and illustrated herein, flood valves 36 are over 0.5 meters (19.685 inches) in diameter, such as 0.8 meters to 1.2 meters (31.4961 inches to 47.2441 inches) in diameter Flood valves 36 being located below water line L, water flow from body of water 6 into tunnels 35*a*, 35*b* is generated by pressure difference, with no need for pumps.

Figure 11:
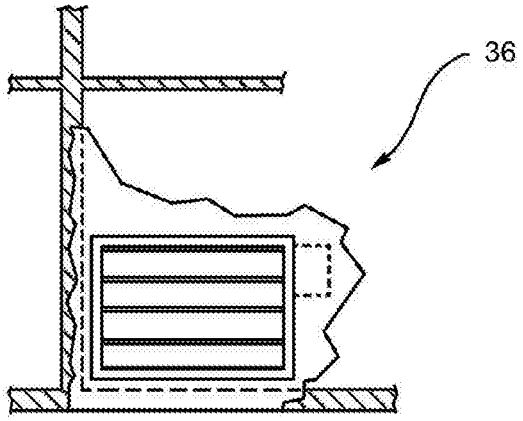
FIG. 11 shows a front view of a third detail of a variation of the system according to the present disclosure.

In one variation, flood valves 36 are gate valves, as shown in FIG. 11.

In another variation not shown in the drawings, flood valves 36 are ball valves.

In certain embodiments, feed valves 37 are large-section throttle valves.

In the non-limiting example described and illustrated herein, feed valves 37 are over 0.5 meters (19.685 inches) in diameter, such as 0.8 meters to 1.2 meters (31.4961 inches to 47.2441 inches) in diameter In one variation, feed valves 37 are ball valves.

In another variation, feed valves 37 are gate valves.

In one variation not shown in the drawings, barge 2 has no tunnels 35*a*, 35*b*, and lower intermediate chambers 33 are connected directly to body of water 6 by respective flood valves. In the absence of tunnels 35*a*, 35*b*, the six lower intermediate chambers 33 are connected to one another by connecting openings along partition 27 and partitions 26 (FIGS. 8 and 9). This provides for relatively fast, even flooding of lower intermediate chambers 33, and therefore greater stability of barge 2.

With reference to FIG. 10, upper intermediate chambers 32 and lower intermediate chambers 33 are connected to one another by one or more fluidic, such as centrifugal, pumps 38 configured to pump water from lower intermediate chambers 33 to upper intermediate chambers 32.

In the non-limiting example described and illustrated herein, each lower intermediate chamber 33 has a pump 38 configured to feed water to the adjacent upper intermediate chamber 32.

In one variation not shown in the drawings, one centrifugal pump is able to pump water from a plurality of lower intermediate chambers 33 to a plurality of upper intermediate chambers 32 simultaneously.

In another variation not shown in the drawings, an extraction system comprises one centrifugal pump; a plurality of extraction lines; and a control configured to selectively draw water from selected lower intermediate chambers 33 to selected upper intermediate chambers 32.

With reference to FIG. 10, upper intermediate chambers 32 have respective fast-drain valves 42 connecting them directly to the outside, and which, when above water line L, provide for draining upper intermediate chambers 32.

In certain embodiments, fast-drain valves 42 are throttle valves.

Each fast-drain valve 42 is controlled by the control device (not shown in the drawings for the sake of simplicity).

Draining upper intermediate chambers 32 relatively rapidly reduces the draft of barge 2.

In certain embodiments, each fast-drain valve 42 is located on the wall separating the respective upper intermediate chamber 32 from the outside.

For maximum drainage, the fast-drain valve 42 is, in certain embodiments, located, on said wall, close to the bottom of respective upper intermediate chamber 32.

As explained in detail below, opening fast-drain valves 42 is extremely useful for emergency recovery of load 3 during transfer.

Finally, barge 2 comprises a conventional auxiliary hydraulic circuit (not shown in the drawings) configured to selectively feed water to, and selectively drain, fore chambers 30 and aft chambers 31.

The auxiliary hydraulic circuit comprises, in certain embodiments, a plurality of centrifugal pumps configured to draw water from body of water 6, and feed the water directly to fore chambers 30 and aft chambers 31.

In the non-limiting example described and illustrated herein, the auxiliary hydraulic circuit is configured to selectively draw water from body of water 6 and feed the water directly to lower intermediate chambers 33 and possibly also to upper intermediate chambers 32, and to drain lower intermediate chambers 33 and possibly also upper intermediate chambers 32.

In one variation not shown in the drawings, the auxiliary hydraulic circuit does not cater to lower intermediate chambers 33 and upper intermediate chambers 32.

In another variation not shown in the drawings, barge 2 has a mechanical system configured to assist connection of load 3 to supporting structure 4. The mechanical system may, for example, comprise relatively heavy-duty hydraulic jacks configured to connect and detach the load faster.

Figure 6:
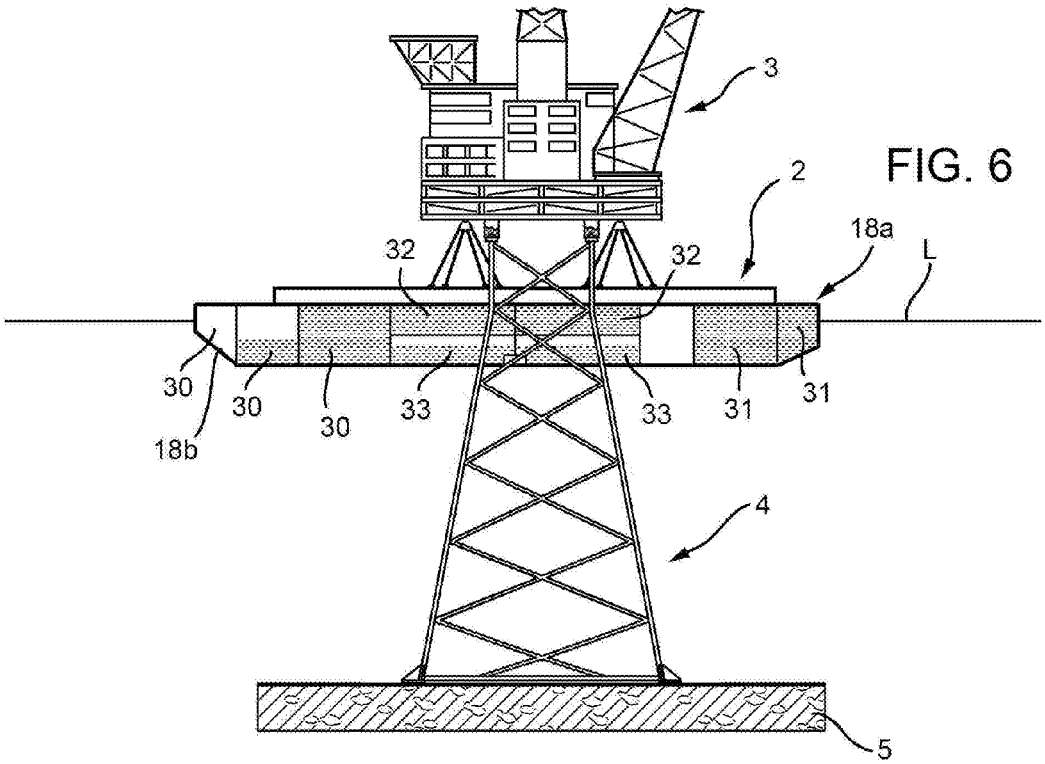
FIG. 6 shows a partly sectioned side view, with parts removed for clarity, of the FIG. 1 system in a fifth operating position.
Figure 7:
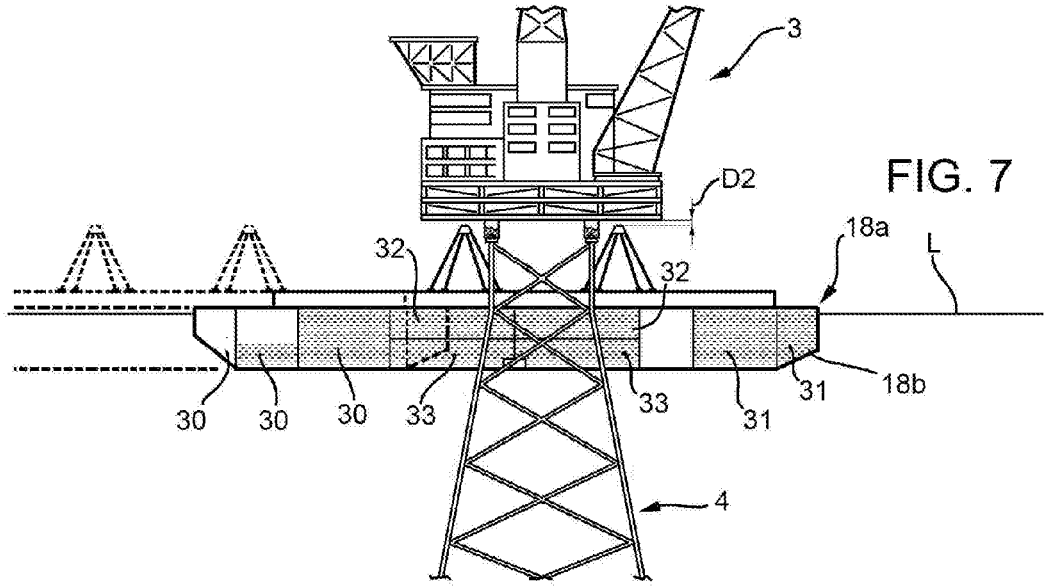
FIG. 7 shows a partly sectioned side view, with parts removed for clarity, of the FIG. 1 system in a sixth operating position.

With reference to FIGS. 2 to 7, the method of transferring load 3 from barge 2 to supporting structure 4 in body of water 6 comprises a plurality of operations described in detail later on and substantially performed in the following order:

- moving barge 2, supporting load 3, up to supporting structure 4 (FIGS. 1 and 2);
- positioning and mooring barge 2 between legs 20 of supporting structure 4, so that load 3 is a distance D1 of about 1 meter to 2 meters (39.3701 inches to 78.7402 inches) from supporting structure 4 (FIGS. 3 and 12);
- first connecting load 3 relatively rapidly to supporting structure 4 to transfer a varying percentage of the load, such as enough to eliminate any relative movement between load 3 and supporting structure 4; in the non-limiting example described and illustrated herein, the load percentage transferred at this stage ranges between 30% and 50% (FIGS. 4 and 13);
- partly transferring the load from 30/50% to 75% (FIGS. 5 and 14);
- relatively rapidly transferring 100% of the load, and detaching barge 2 from load 3 to a distance D2 of at least 1 meter to 2 meters (39.3701 inches to 78.7402 inches) between barge 2 and load 3 (FIGS. 6 and 15);
- moving barge 2 clear of supporting structure 4 (as shown by the dash lines in FIG. 7).

In certain embodiments, the partial load transfer step (from 30/50% to 75%) is optional. In these embodiments, the load may be substantially transferred in two steps: the relatively fast connecting step, in which a varying percentage of the load is transferred to prevent any relative movement between load 3 and supporting structure 4; and the full load transfer step.

More specifically, barge 2 is moved up to supporting structure 4 by tow. In the non-limiting example described herein barge 2 is not self-propelled.

In a variation not shown in the drawings, barge 2 is self-propelled.

To adjust the attitude of barge as barge is being transported, some of the plurality of chambers 28 on barge 2 are fully or partly flooded with water. In the non-limiting example shown in FIG. 2, at least three fore chambers 30 and one aft chamber 31 are fully or partly flooded to ensure a stable attitude of barge 2. The step of flooding the three fore chambers 30 and one aft chamber 31 is performed by the auxiliary hydraulic circuit.

Once positioned between legs 20 of supporting structure 4, barge 2 is moored to legs 20 by mooring lines, and possibly also with the aid of commonly used horizontal motion suppressors (not shown in the drawings) such as elastic mechanical abutting elements (pistons) or bumpers ('ocean cushions').

When positioned between legs 20 of supporting structure 4, barge 2 must be immersed in body of water 6 so that ends 16 of pylons 14 of load 3 are a distance D1 of about 1 meter to 2 meters (39.3701 inches to 78.7402 inches) from ends 24 of supporting members 23 of legs 20 (FIGS. 2 and 12).

When transporting, positioning, and mooring the barge, flood valves 36 of tunnels 35*a*, 35*b* are closed, and the draft P of barge 2 is roughly 5.5 meters (216.535 inches), as shown in FIG. 12. Here and hereinafter, draft P is intended to mean the substantially vertical distance between the bottom of underbody 18*b* of barge 2 and water level L (FIG. 2).

Figure 3:
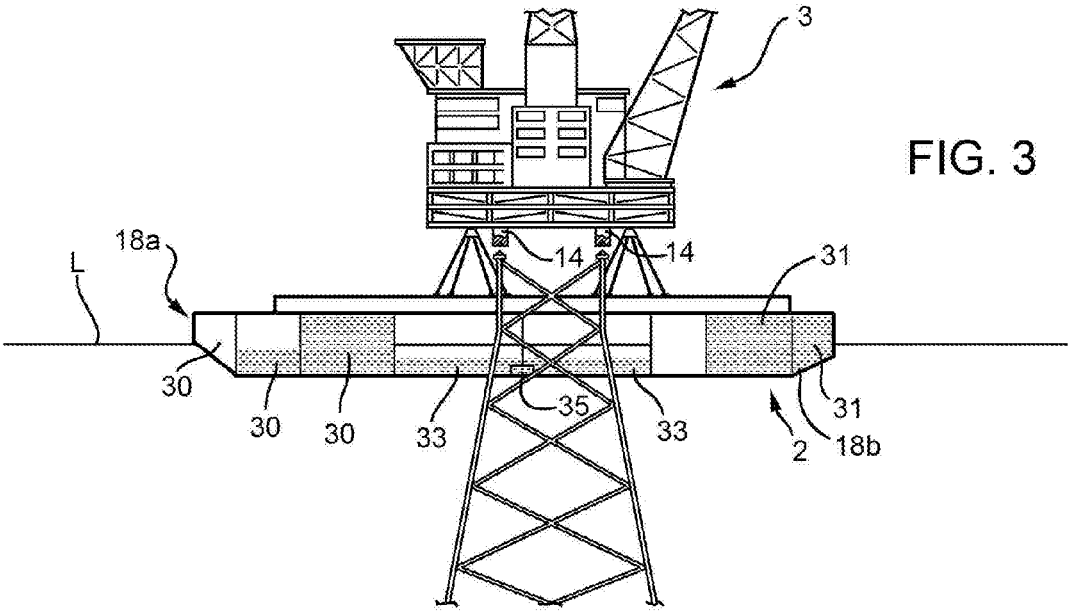
FIG. 3 shows a partly sectioned side view, with parts removed for clarity, of the FIG. 1 system in a second operating position.

With reference to FIG. 3, once barge 2 is moored, lower intermediate chambers 33 are flooded with water, and barge 2 is immersed in body of water 6 to reduce distance D1 and bring ends 16 of pylons 14 of load 3 into contact with ends 24 of supporting members 23 of legs 20 (FIG. 2).

It should be appreciated that in various embodiments, connecting the load is one of the most critical steps in the transfer method according to the present disclosure, and therefore one that calls for relatively extremely fast flooding of lower intermediate chambers 33. In the non-limiting example described and illustrated herein, the time taken to bring end 16 of each pylon 14 of load 3 into contact with end 24 of corresponding supporting member 23 of legs 20 is in the region of a few minutes.

More specifically, lower intermediate chambers 33 are flooded by simply opening flood valves 36 located below water line L.

Figure 4:
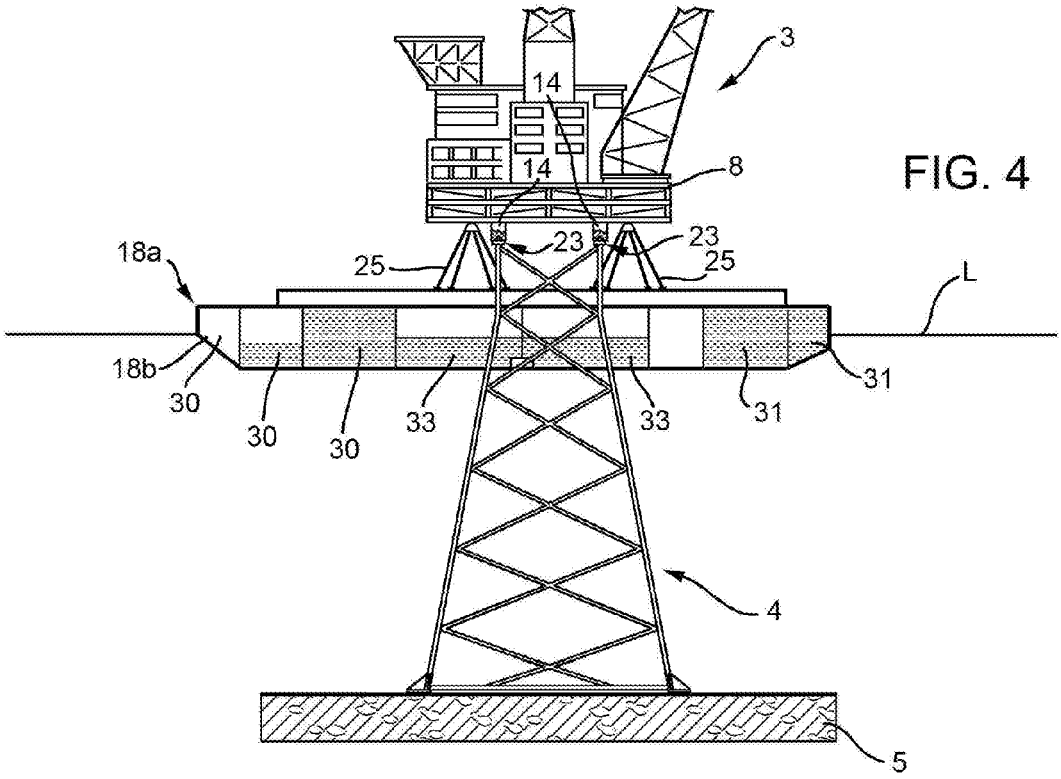
FIG. 4 shows a partly sectioned side view, with parts removed for clarity, of the FIG. 1 system in a third operating position.
Figure 13:
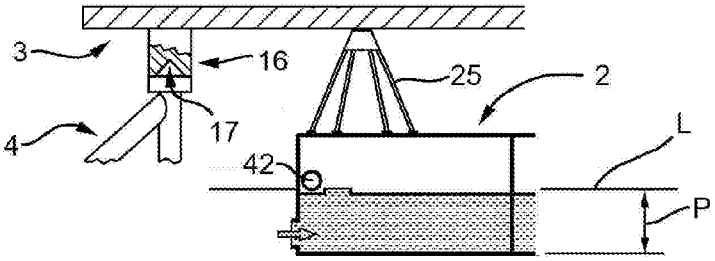

With reference to FIGS. 4 and 13, by the time the load is connected, lower intermediate chambers 33 are completely flooded to transfer part of load 3 to supporting structure 4 (FIG. 4). In the non-limiting example shown, the percentage of load 3 transferred to supporting structure 4 at this stage ranges between 30% and 50%. This provides for a stable configuration by eliminating any relative movement between load 3 and supporting structure 4.

In the FIGS. 4 and 13 configuration, flood valves 36 of tunnels 35*a*, 35*b* are open, and draft P of barge 2 is around 7.5 meters (295.276 inches) (FIG. 13).

Figure 5:
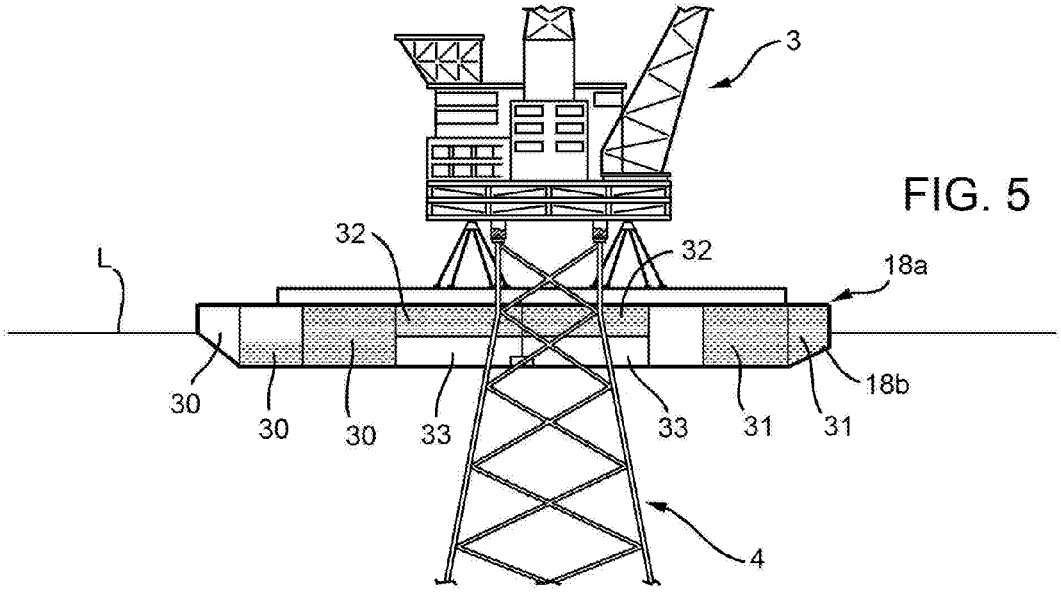
FIG. 5 shows a partly sectioned side view, with parts removed for clarity, of the FIG. 1 system in a fourth operating position.
Figure 14:
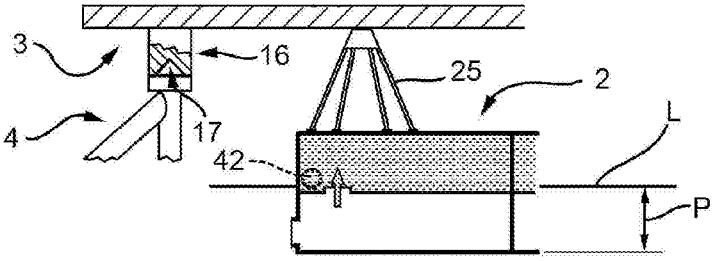

With reference to FIGS. 5 and 14, upper intermediate chambers 32 are flooded by fluidic pumps 38 (FIG. 10) drawing water from lower intermediate chambers 33.

When drawing water from lower intermediate chambers 33, flood valves 36 of tunnels 35*a*, 35*b* are closed, and draft P of barge 2 remains unchanged at about 7.5 meters (295.276 inches) (FIG. 14).

In an emergency (such as a sudden change in weather conditions), upper intermediate chambers 32 can be drained rapidly by opening fast-drain valves 42 (FIG. 10). This causes rapid emersion of barge 2, and load 3 is transferred back to barge 2.

The time taken to fill upper intermediate chambers 32 is in the region of a few hours. Since load 3 has already been connected to supporting structure 4, the ballast water is transferred by fluidic pumps 38 (FIG. 10) from lower intermediate chambers 33 to upper intermediate chambers 32 in a relatively stable, reversible configuration.

Figure 15:
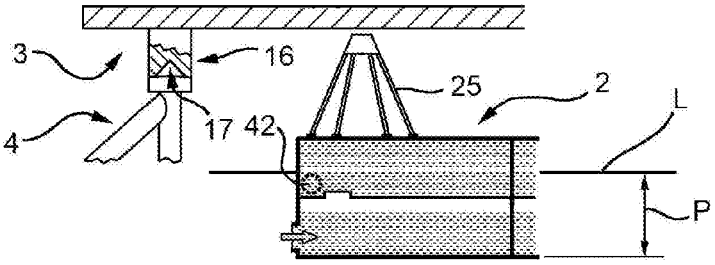

With reference to FIGS. 6 and 15, once upper intermediate chambers 32 are filled, lower intermediate chambers 33 may be partly filled to increase draft P of barge 2 and assist transferring from 50% to roughly 75% of load 3 to supporting structure 4.

At this stage, lower intermediate chambers 32 may be filled partly by the auxiliary hydraulic circuit, if provided.

In this configuration, draft P of the barge increases to around 8.5 meters (334.646 inches), as shown in FIG. 15. As lower intermediate chambers 33 fill up, load 3 begins detaching from barge 2.

Figure 16:
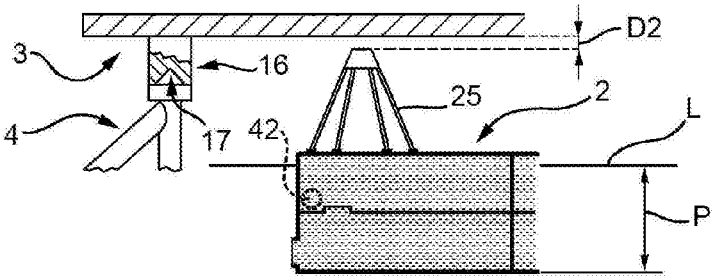

With reference to FIG. 7, lower intermediate chambers 33 are filled completely to increase draft P of barge 2 to around 9.5 meters (374.016 inches), as shown in FIG. 16. Draft P must be increased to produce a distance D2 of about 1 meter to 2 meters (39.3701 inches to 78.7402 inches) between supports 25 of barge 2 and bottom face 10 of deck 8 of load 3. Distance D2 must be sufficient to enable barge 2 to exit the transfer position without touching load 3.

Final filling of lower intermediate chambers 33 is performed relatively rapidly, in the space of a few minutes, thus safeguarding against surge-induced collision.

At this stage, filling lower intermediate chambers 33 necessarily calls for opening flood valves 36.

The dash lines in FIG. 7 indicate barge 2 exiting from the transfer position.

It is understood that all the steps in the method described above may comprise controlled flooding or draining of fore chambers 30 and aft chambers 31 to adjust the draft or simply the attitude of barge 2.

Clearly, changes may be made to the barge and to the system and method of transferring a load from a barge to a supporting structure in a body of water, as described herein, without, however, departing from the scope of the accompanying Claims. Accordingly, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A variable-draft barge configured to transfer a load in a body of water, said barge comprising:
- a hull;
- an underbody;
- a first chamber located in the hull and being selectively floodable to alter a draft of the barge;
- a second chamber located at a higher level than the first chamber, said second chamber being selectively floodable;
- a flood valve located below a water line and configured to enable a flood of the first chamber, said water line being a function of the draft of the barge;
- a control device configured to selectively open the flood valve to flood the first chamber; and
- a pump configured to transfer water from the first chamber to the second chamber.

2. The variable-draft barge of claim 1, wherein the flood valve is located along the underbody.

3. The variable-draft barge of claim 1, wherein the flood valve includes a throttle valve.

4. The variable-draft barge of claim 1, wherein the flood valve includes a gate valve.

5. The variable-draft barge of claim 1, wherein the flood valve is over 0.5 meters in diameter.

6. The variable-draft barge of claim 5, wherein the flood value is 0.8 meters to 1.2 meters in diameter.

7. The variable-draft barge of claim 1, wherein the second chamber has at least one fast-drain device connecting the second chamber to an outside of the barge.

8. The variable-draft barge of claim 7, wherein the fast-drain device includes a fast-drain valve configured to drain the second chamber when the fast-drain valve is above the water line.

9. The variable-draft barge of claim 1, wherein the second chamber is adjacent to the first chamber.

10. The variable-draft barge of claim 9, wherein the second chamber is over the first chamber.

11. The variable-draft barge of claim 1, which includes a plurality of additional chambers connected to one another by connecting openings, wherein at least one of the additional chambers is connected to the first chamber by at least one of the connecting openings.

12. A load transferring system comprising:
- a load;
- a variable-draft barge including:
  - a hull,
  - an underbody,
  - a first chamber located in the hull and being selectively floodable to alter a draft of the barge,
  - a second chamber located at a higher level than the first chamber, said second chamber being selectively floodable,
  - a flood valve located below a water line and configured to enable a flood of the first chamber, said water line being a function of the draft of the barge,
  - a control device configured to selectively open the flood valve to flood the first chamber, and
  - a pump configured to transfer water from the first chamber to the second chamber; and
- a supporting structure resting on a bed of a body of water and having at least one supporting member connectable to the load.

13. The load transferring system of claim 12, wherein the load is at least a deck unit.

14. The load transferring system of claim 12, wherein the load includes a plurality of coupling members, each with a coupling seat being engageable by a respective supporting member of the supporting structure.

15. A method of transferring a load from a barge to a supporting structure in a body of water, said barge including a hull, an underbody, a first chamber located in the hull and being selectively floodable to alter a draft of the barge, a flood valve located below a water line and configured to enable a flood of the first chamber, said water line being a function of the draft of the barge, and a control device configured to selectively open the flood valve to flood the first chamber, and the supporting structure resting on the bed of the body of water and having a supporting member connectable to the load, said method comprising:
- (a) moving the load, equipped with a coupling member, into a transfer position via the barge supporting the load;
- (b) increasing the draft of the barge by opening the flood valve, flooding at least the first chamber and pumping the water in the first chamber to at least one second chamber at a higher level than the first chamber to:
  - (i) lower the load,
  - (ii) bring the coupling member of the load into contact with the supporting member of the supporting structure, and
  - (iii) completely transfer the load from the barge to the supporting structure; and
- (c) moving the barge from the transfer position.

16. The method of claim 15, wherein increasing the draft of the barge includes flooding at least the first chamber again after pumping the water from the first chamber to the at least one second chamber.

17. The method of claim 15, which includes reducing the draft of the barge by draining the at least one second chamber using a fast-drain device.

18. The method of claim 17, wherein draining the at least one second chamber includes opening at least one fast-drain valve of the at least one second chamber when the at least one fast-drain valve is above the water line.

19. A variable-draft barge configured to transfer a load in a body of water, said barge comprising:

a hull;

an underbody;

a first chamber located in the hull and being selectively floodable to alter a draft of the barge;

a plurality of additional chambers including:

a plurality of fore additional chambers;

a plurality of aft additional chambers; and a plurality of lower intermediate additional chambers located between the aft additional chambers and the fore additional chambers;

a plurality of upper intermediate second chambers connected to the lower intermediate additional chambers by at least one pump;

a flood valve located below a water line and configured to enable a flood of the first chamber and at least one of the lower intermediate additional chambers, said water line being a function of the draft of the barge;

a first tunnel connecting the body of water to at least one of the plurality of additional chambers, the flood valve communicating fluidically with the first tunnel; and a control device configured to selectively open the flood valve to flood the first chamber.

20. The variable-draft barge of claim 19, wherein the at least one of the additional chambers is connected to the first tunnel.

21. The variable-draft barge of claim 20, wherein said connection is via a feed valve.

22. The variable-draft barge of claim 21, wherein the control device is configured to selectively open and close the feed valve.

23. The variable-draft barge of claim 19, wherein the first tunnel is located at a bottom of the hull, substantially halfway along an axis of the hull.

24. The variable-draft barge of claim 19, which includes a second tunnel in fluidic communication with another one of the plurality of additional chambers.

25. The variable-draft barge of claim 24, wherein the second tunnel is perpendicular to the first tunnel.

26. The variable-draft barge of claim 24, wherein the second tunnel is in fluidic communication with the first tunnel.

* * * * *